US006861603B1

(12) United States Patent
Wang

(10) Patent No.: US 6,861,603 B1
(45) Date of Patent: Mar. 1, 2005

(54) STRUCTURE OF BUTTON FOR ELECTRONIC PRODUCT

(75) Inventor: Yung-Hui Wang, Taipei (TW)

(73) Assignee: Paten Wireless Technology Inc., Taipei (TW)

( * ) Notice: Subject to any disclaimer, the term of this patent is extended or adjusted under 35 U.S.C. 154(b) by 0 days.

(21) Appl. No.: 10/745,692

(22) Filed: Dec. 29, 2003

(51) Int. Cl.[7] ..... H01H 13/70
(52) U.S. Cl. ..... 200/344
(58) Field of Search ..... 200/5 A, 517, 200/344, 345; 400/490–496

(56) References Cited

U.S. PATENT DOCUMENTS 6,020,565 A * 2/2000 Pan ..... 200/344
6,225,586 B1 * 5/2001 Watanabe et al. ..... 200/344
6,371,671 B1 * 4/2002 Sato et al. ..... 400/495
6,417,470 B2 * 7/2002 Kako et al. ..... 200/344
6,455,794 B2 * 9/2002 Sato et al. ..... 200/344
6,501,038 B2 * 12/2002 Hayashi et al. ..... 200/344
6,586,695 B2 * 7/2003 Sato et al. ..... 200/344
6,597,344 B1 * 7/2003 Narusawa et al. ..... 345/168
6,747,867 B2 * 6/2004 Hsu ..... 361/680
6,777,634 B2 * 8/2004 Narusawa et al. ..... 200/344

* cited by examiner

*Primary Examiner*—Michael A. Friedhofer
(74) *Attorney, Agent, or Firm*—Birch, Stewart, Kolasch & Birch, LLP

(57) ABSTRACT

A structure of button for an electronic product has an upper lid, a chassis having a switch and a parallel bar set, which positioned between the upper lid and the chassis, such that the upper lid can move down upon being depressed by an external force to activate the switch of the chassis and can substantially return to its original position upon removing the external force. The parallel bar set has a base, two supporting racks, positioned parallel to each other above the base, wherein a side of one of the two supporting racks is connected to a positioning bar and the positioning bar is buckled to the base, the positioning bar and two supporting racks are positioned between the chassis and the upper lid to enable the upper lid to move towards the chassis under the influence of a movement of the parallel bar set.

8 Claims, 7 Drawing Sheets

STRUCTURE OF BUTTON FOR ELECTRONIC PRODUCT

BACKGROUND OF THE INVENTION

1. The Field of the Invention

The present invention relates to a structure of button for an electronic product, and more particularly to a structure of button comprising a parallel bar set positioned between an upper lid and a chassis such that the length of a positioning bar of the parallel bar set limits the moving distance between the lid and the chassis.

2. Description of Related Art

Presently, the well-developed electronic technology produced advanced electronic products that provide convenience in our daily activities. Most electronic products require an input device for enabling the user to input letters, numbers or commands enjoy the functions provided by the electronic products. Examples of such input devices include mouse, keyboard or joystick and light beam gun for games. The development of these products later led to development, for instance, from buttons on the keyboard for the conventional desktop computer to the buttons for the notebook computer. The notebook computer being lighter, thinner, shorter and smaller than a desktop computer, the structure of the buttons of the notebook computer cannot be same as the ones applied in the keyboard of the desktop computer. Extensive research and development resulted into invention of a new scissor structure and new method of installing the buttons on the scissor structure that can be applied to a notebook computer. Referring to FIGS. 7 and 8, an exploded view and a side view of a conventional scissors structure of a button for an electronic product are respectively shown. As shown, the button comprises a first supporting rack A and a second supporting rack B. The second supporting rack B has an axle B1, which is axially fitted into the groove A1 of the first supporting rack A. The sliding element A2 of the first supporting rack A and the sliding element B2 of the second supporting rack B are fitted into the sliding groove C1 of the base C and the sliding groove D1 of the cap D respectively to position the securing element A3 of the first supporting rack A into the axial hole C2 of the base 3 and the securing element B3 of the second supporting rack B into the axial hole D2 of the cap D axially. When the user press the cap D, the cap D will come down with the force of the first and second supporting racks A and B.

However, there are several defects with the conventional scissors structure, the buttons for the scissors structure and the installation method described as follows.

1. The first and second supporting racks A and B of the conventional buttons have a fixed the moving distance between the base C and cap D, thus it is difficult make any modification for fitting various specification of a variety of electronic products. Accordingly, a specific structure is designed for each product, and therefore the manufacturing cost is substantially increased.
2. The scissor structure of the conventional button is consisted of the first and second supporting racks A and B, the axle B1 and the groove A1 will be dislodged due the friction after repeated pressing operation causing dislocation and may jam up the first and second supporting racks A and B.
3. The cap D of the conventional button requires a sliding groove D2 for allowing the first supporting rack A to move when the cap D comes down, thus the size of the cap D is limited and cannot be smaller and therefore cannot fit the specification of the electronic products of the present trend of being lighter, thinner, shorter and smaller.

Therefore, how to solve the above defects of the conventional design has become an important issue for the manufacturer in the field.

SUMMARY OF THE INVENTION

Accordingly, in the view of the foregoing, the present inventor makes a detailed study of related art to evaluate and consider, and uses years of accumulated experience in this field, and through several experiments, to create a structure of a button for electronic products. The present invention provides an innovated cost effective structure of a button for electronic products, which structure can fit for a variety of electronic products that fit in the present trend of being lighter, thinner, shorter and smaller.

According to an aspect of the present invention, the length of the positioning bar is adapted to limit the distance between the upper lid and the chassis, and therefore the distance between the upper lid and the chassis can be adjusted by adjusting the length of positioning bar. In other words, for applying the structure of the button of the present invention an electronic product of a particular specification, the positioning bar of a desirable length can be selected to meet the specification of the electronic product, and thus need for replacement of all of the components of the button as in the case conventional art can be effectively avoided. Accordingly, the structure of the button of the present invention can be applied to a broad range of electronic products. Further, because the distance between the upper lid and the chassis can be shortened as desired, and therefore it can meet with the present trend of lighter, thinner, shorter and smaller.

According to another aspect of the present invention, the supporting racks are used for connecting the upper lid and the chassis, and therefore there will be no friction and thereby the jamming of the supporting racks can be effectively eliminated.

According to another aspect of the present invention, the supporting racks between the upper lid and the chassis are directly axially assembled so that the size of the upper lid is not limited and can be small as possible to fit the specification of various electronic products of the present trend of being lighter, thinner, shorter and smaller.

BRIEF DESCRIPTION OF THE DRAWING

For a more complete understanding of the present invention, reference will now be made to the following detailed description of preferred embodiments taken in conjunction with the following accompanying drawings.

DETAILED DESCRIPTION OF PREFERRED EMBODIMENTS

Figure 1:
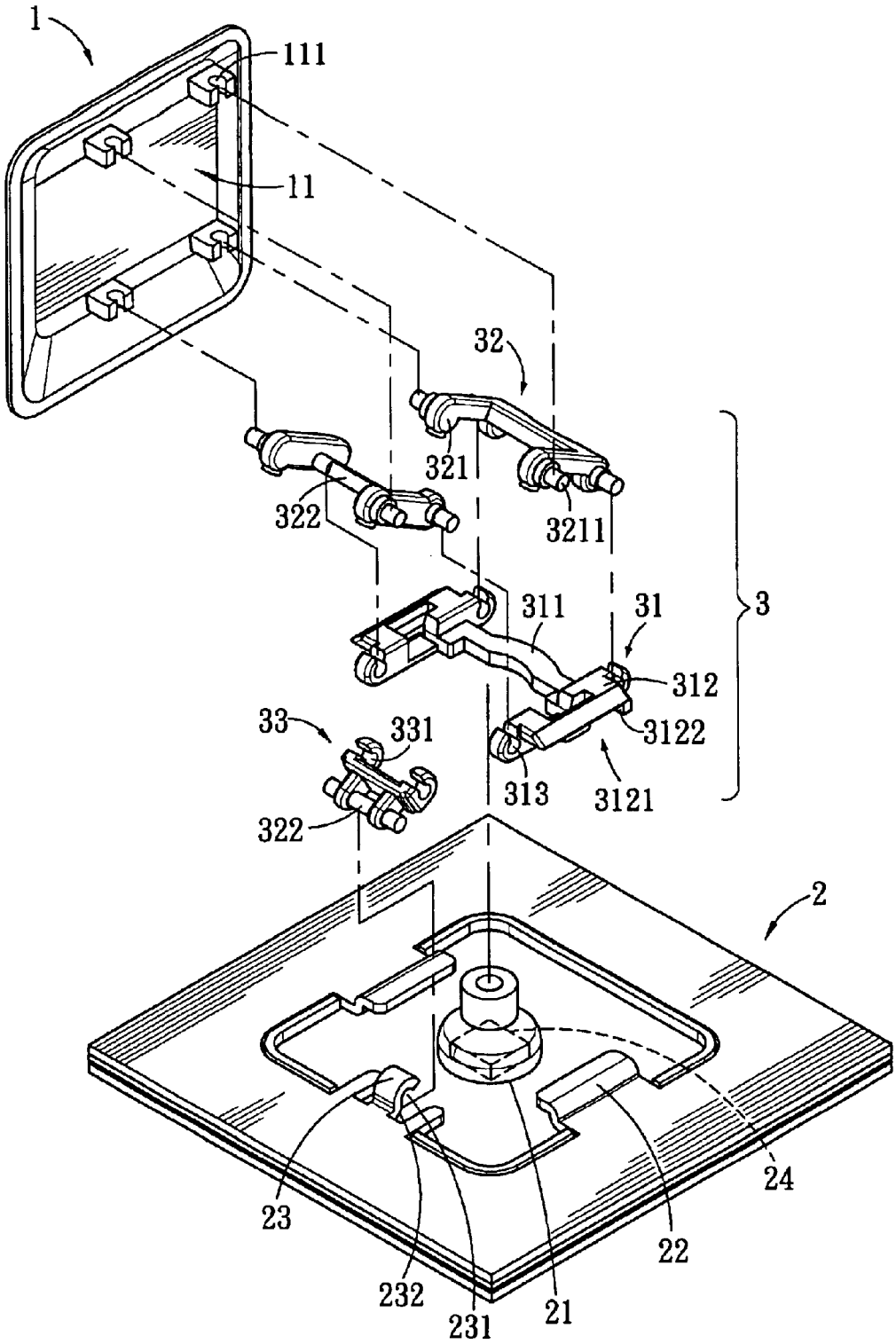
FIG. 1 is an exploded view showing a structure of a button for an electronic product according to a preferred embodiment of the present invention.

Reference will be made in detail to the preferred embodiments of the invention, examples of which are illustrated in the accompanying drawings. Wherever possible, the same reference numbers are used in the drawings and the description to refer to the same or like parts.

In FIG. 1, an exploded view of a structure of a button for an electronic product according to a preferred embodiment of the present invention is shown. The structure of the button comprises an upper lid 1, a chassis 2 and a parallel bar set 3.

A receiving space 11 having a plurality of protruded axial holes 111 is formed above upper lid 1.

A switch 24 is disposed on a surface of the chassis 2, wherein the switch 24 is covered by a resilient element 21. The switch 24 comprises tracks 22 on the two sides thereof. Each track 22 has an open buckling element 23 set on a side of a buckling groove 231 is formed, and the buckling groove 231 is conjoint to a sliding face 232.

The parallel bar set 3 comprises a base 31 having a bottom portion 311. Two axial portions 312 are formed on two sides of the bottom portion 311, wherein each axial portion 312 has a groove 3121 on a side thereof. The groove 3121 has a stopping portion 3122 at a side thereof. The above axial portion 312 has axial holes 313, for example, open sided holes as shown in FIG. 1, at the two ends thereof. Two supporting racks 32 having axial portions 321 at the two sides thereof are positioned on the base 31. The two ends of the axial portions 321 respectively comprise an axle 3211. A bar 322 is positioned on an axial portion 321 of one of the supporting racks 32. Furthermore, the base 31 has a positioning bar 33 at a side thereof. The positioning bar 33 has a positioning axial hole 331, for example, an open sided hole as shown in FIG. 1, at a distal end and a positioning axle 332 at a primal end thereof.

Figure 2:
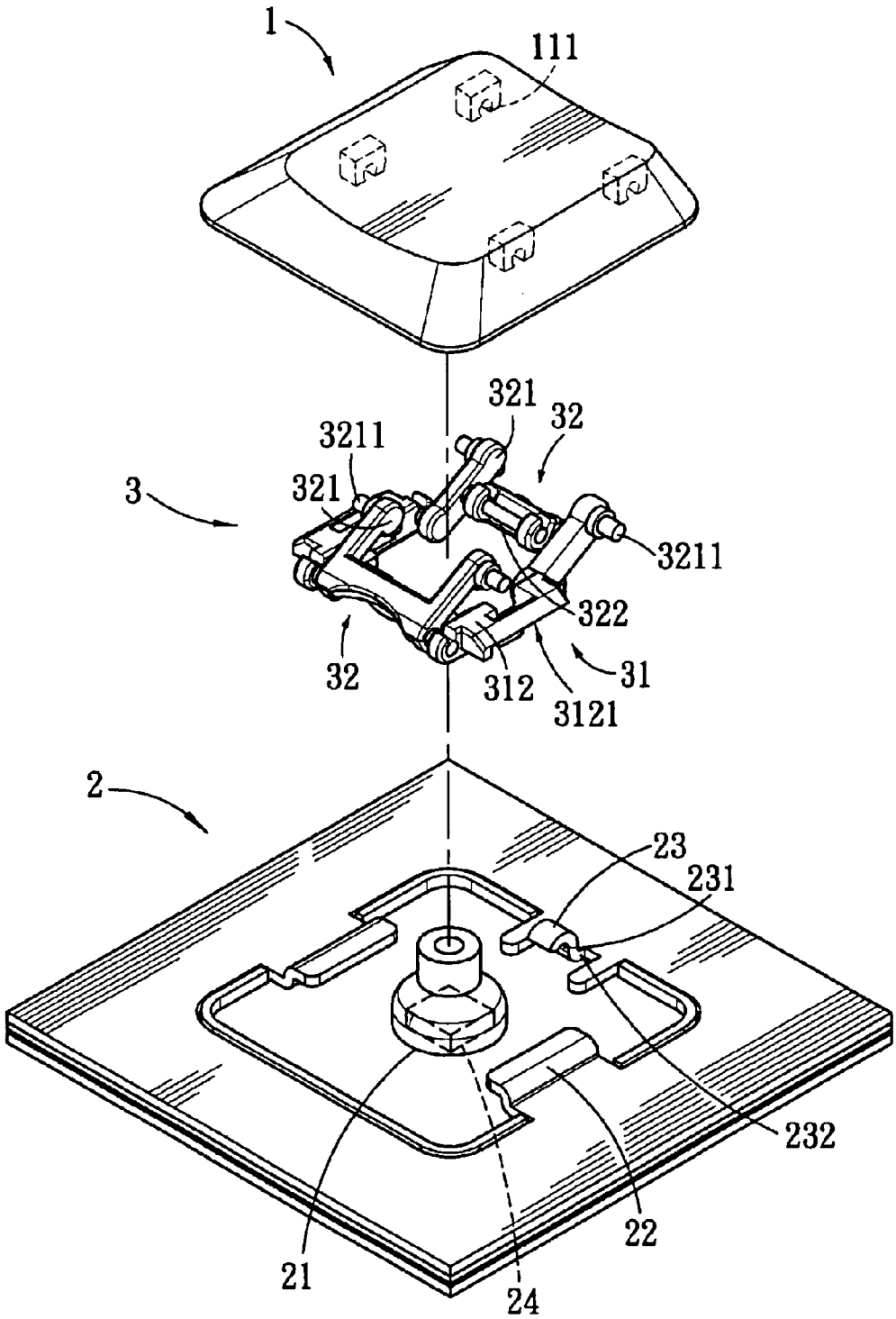
FIG. 2 is an exploded view showing while assembling of the structure of the button for an electronic product according to a preferred embodiment of the present invention.
Figure 3:
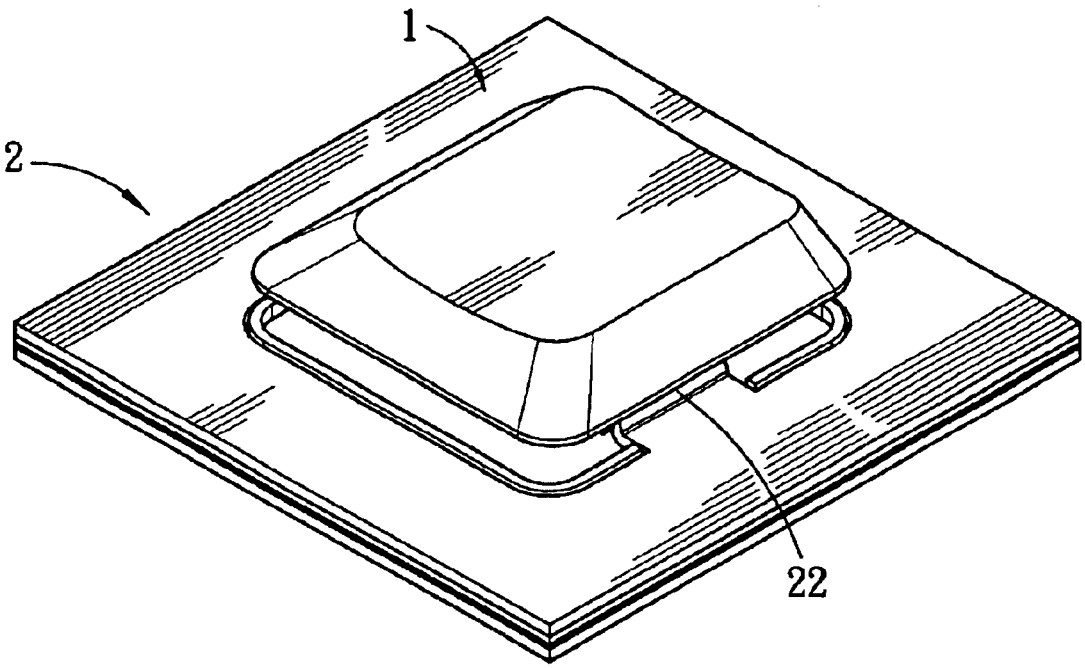
FIG. 3 is an exploded view showing after assembling of the structure of the button for an electronic product according to a preferred embodiment of the present invention.

Now the assembly of the structure of the button of the present invention is described below with reference to FIGS. 1, 2 and 3. FIGS. 1, 2 and 3 respectively show an exploded view showing a structure of a button for an electronic product according to a preferred embodiment of the present invention, and an exploded view showing while and after assembly of the structure of the button for an electronic product according to a preferred embodiment of the present invention. As shown, the grooves 3121 positioned at the two sides of the base 31 is slid into the track 22 until the stopping portion 3122 formed at a end of the groove 3121 is supported against the track 22 for positioning. Next, the axles 3211 formed on the two sides of the supporting rack 32 positioned into the axial hole 313 formed on the two sides of the base 31 and the axial holes 111 of the upper lid 1 such that the upper lid 1 is supported against an upper flange of the resilient element 21 formed on the chassis 2. Next, the positioning axle 332 of the positioning bar 33 is buckled into the buckling groove 231 of the chassis 2. Finally, the bar 322 of the supporting rack 32 is fitted into the positioning axial hole 331 of the positioning bar 33 to complete the assembly of the structure of the button of present invention.

Figure 4:
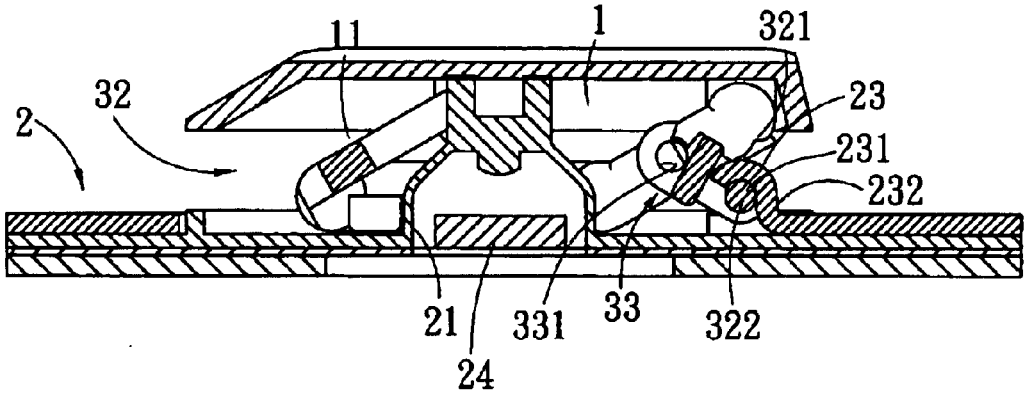
FIG. 4 is a sectional side view of the structure of the button for an electronic product according to a preferred embodiment of the present invention.
Figure 5:
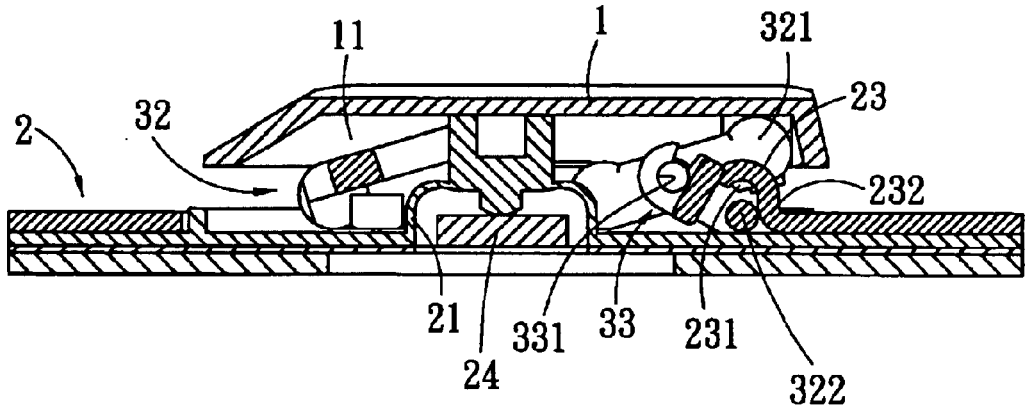
FIG. 5 is a sectional side view showing while pressing the button of the structure of the button according to a preferred embodiment of the present invention.

Now, the working of the structure of the button of the present invention will be described with reference to FIGS. 4 and 5. FIGS. 4 and 5, respectively show a sectional side view of the structure of the button and a sectional side view while pressing the button of the structure of the button according to a preferred embodiment of the present invention. As shown, when a user depresses the button by pressing onto the upper lid 1, the supporting rack 32 of the parallel bar set 3 will move downwardly making the upper lid 1 press against the resilient element 21 causing it to elastically deform and come in contact with the switch 24. Meanwhile, the shape of the resilient element 21 can be restored due to its elastic property. The positioning axle 332, which is being buckled into the buckling groove 231 is moved by the sliding face 232 conjoining to the buckling groove 231 under the influence of the pressing force of the user. And when the user releases the upper lid 1, the upper lid 1 is substantially restored to its original by the elastic property of the resilient element 21.

Figure 6:
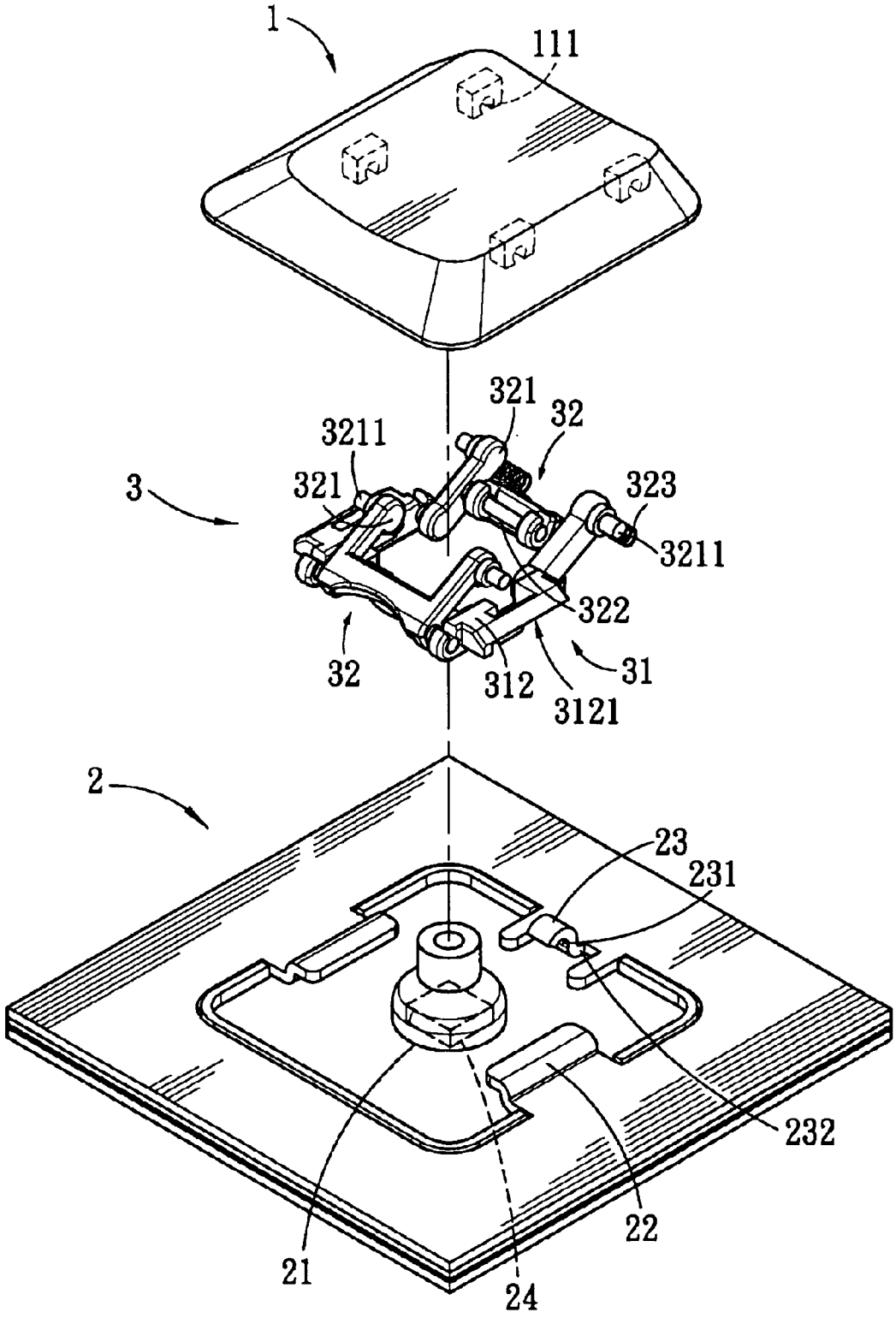
FIG. 6 is a sectional side view of a structure of the button for an electronic product according to another preferred embodiment of the present invention.
Figure 7:
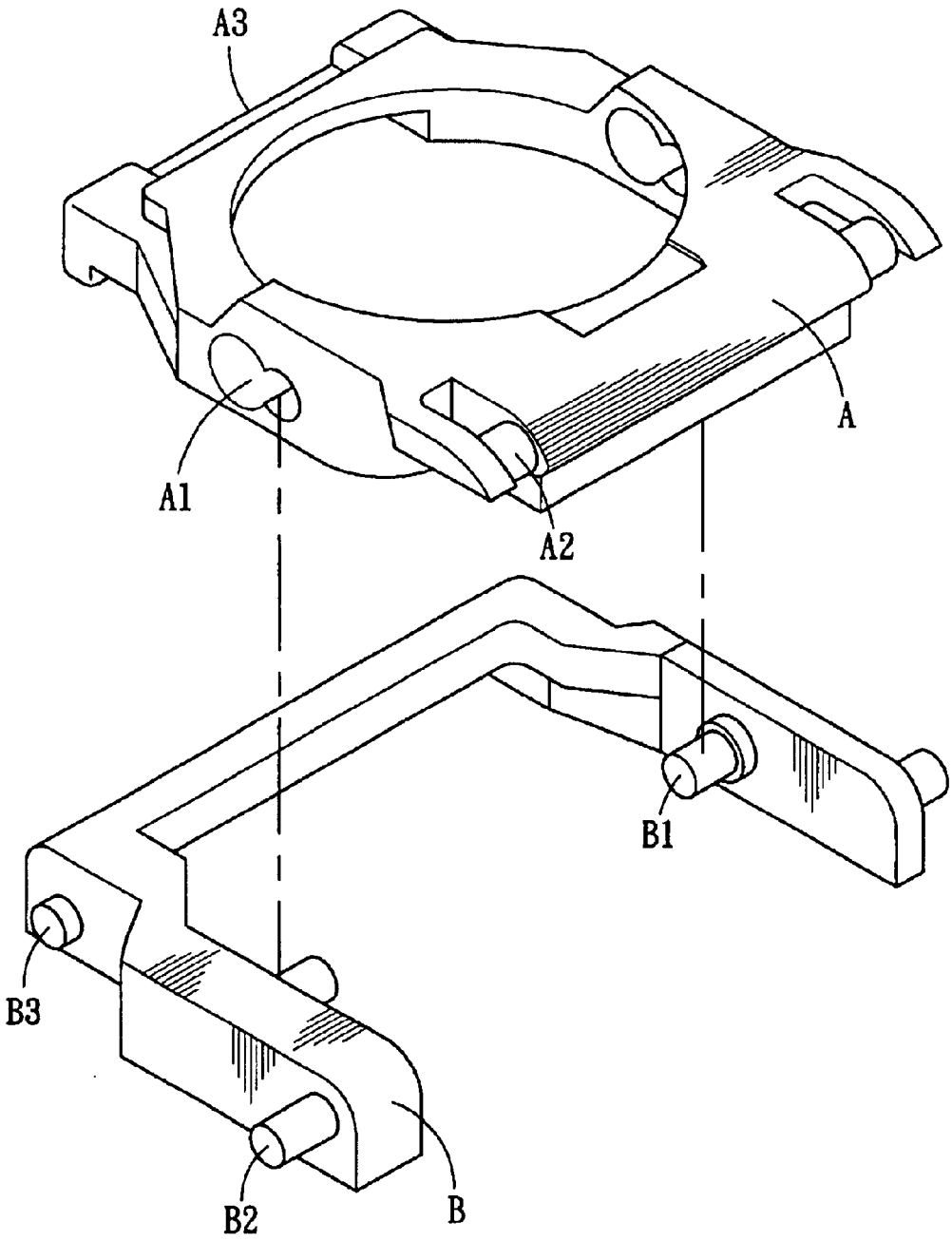
PRIOR ART FIG. 7
FIG. 7 is an exploded view of a conventional scissors structure of a button for an electronic product.
Figure 8:
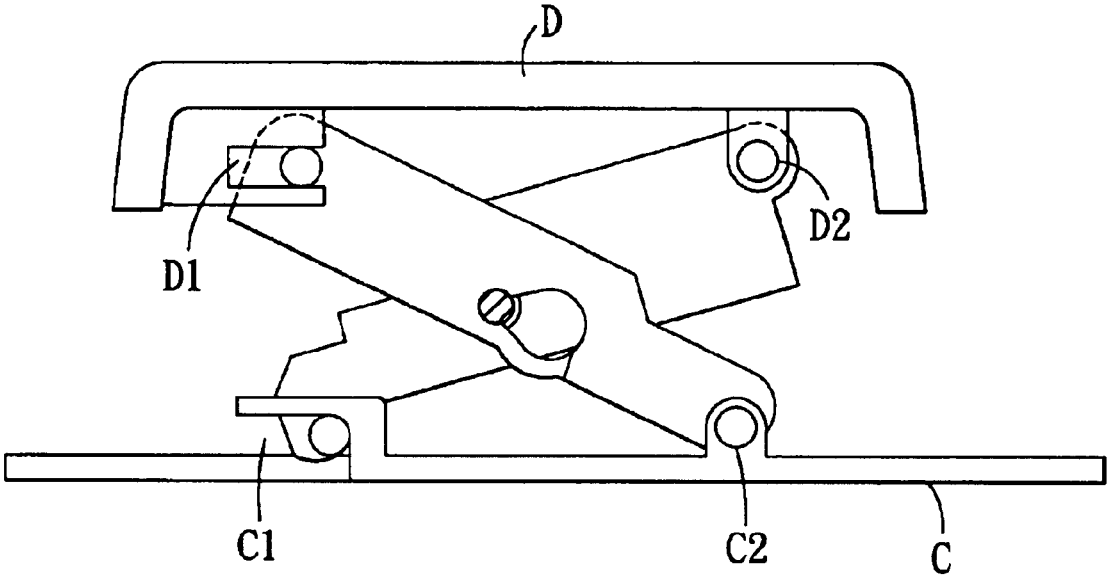
PRIOR ART FIG. 8
FIG. 8 is a side view of a conventional scissors structure of a button for an electronic product.

Furthermore, in the preferred embodiment of the present invention, the positioning axle hole 331 and the positioning axle 332 of the positioning bar 33 are used to limit the extent of the movement between the upper lid 1 and the chassis 2, therefore this makes it possible to tailor the length of the positioning bar 33 to adjust the range of the movement between the upper lid 1 and the chassis 2 instead of changing or replacing any other components. Furthermore, a receiving space at the distal end formed on two sides of the supporting rack 32, a spring 323 may be disposed in the receiving space to enable the upper lid 1 return to its original position after pressing force is removed (as shown in FIG. 6).

Now, a process of making the structure of the button of the present is described below with reference to FIGS. 1 and 2. The structure of the button of the present invention can be formed in a two-step injection mold process or the components making the parallel bar set 3 assembled into an integral unit to form the structure of button. First, a suitable material is injected through the two entrances of the mold to form two supporting racks 32. Next, the mold is turned for injecting a suitable material through another two entrances of the mold to form the base 31 and the positioning bar 33. Meanwhile, the axles 3211 on the axial portion 321 of the two supporting racks 32 will be positioned in the axial hole 313 of the base 31 and the positioning axial hole 331 of the positioning bar 33. Thus the assembly process can be accomplished by a simple method.

The structure of the button of the present invention has at least the following advantages:

1. The present invention uses the positioning axial hole 331 and the positioning axle 332 of the positioning bar 33 to limit the movement between the upper lid 1 and the chassis 2. This arrangement allows adjustment of the length of the positioning bar 33 to adjust range of the movement between the upper lid 1 and the chassis 2. Therefore, the range of the movement between the upper lid 1 and the chassis 2 can be adjusted to a desired range by tailoring the length of the positioning bar 33. Thus the structure of the button of the present invention fits the present trend for making lighter, thinner, shorter and smaller electronic products.
2. The two supporting racks 32 is fitted to the upper lid 1 and the base 31 respectively, in a manner that there is no friction between the two supporting tracks 32 so that jamming of the supporting racks 32 after repeated depression of the upper lid 1 can be effectively eliminated.

3. The supporting racks 32 are fitted directly to the upper lid 1 and the chassis 2 so that the size of the upper lid 1 can be as small as possible so that it can be applied in various electronic products.

4. The structure of the button of the present invention can be formed in a two-step process making the parallel bar set 3 to assemble into an integral unit and therefore the cost can be effectively reduced.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A structure of button for an electronic product, comprising:

an upper lid;

a chassis, having a switch; and a parallel bar set, positioned between said upper lid and said chassis, such that said upper lid can move down upon being depressed by an external force to activate said switch of said chassis and can substantially return to an original position upon removing said external force, wherein said parallel bar set comprises a base;

two supporting racks, positioned parallel to each other above said base, wherein a side of each of said two supporting racks is connected to a positioning bar and said positioning bar is buckled to said base, said positioning bar and said two supporting racks are positioned between said chassis and said upper lid to enable said upper lid to move towards said chassis under the influence of a movement of said parallel bar set.

2. The structure of button for an electronic product according to claim 1, wherein said two supporting racks comprises at least two sets of axles positioned at two sides thereof, and one of said two sets of said axles is axially connected to a plurality of axial holes of said upper lid, and the other set of axles is axially connected to axial holes formed on two sides of said base.

3. The structure of button for an electronic product according to claim 1, wherein said positioning bar comprises a positioning axial hole at one end and a positioning axle at another end thereof, and wherein said positioning axle buckles to an open buckling element set formed on a side of said chassis, said positioning axial hole is for fitting a bar positioned on one of said supporting racks.

4. The structure of button for an electronic product according to claim 3, wherein said buckling element comprises a buckling groove with a sliding face.

5. The structure of button for an electronic product according to claim 1, wherein said switch comprises tracks on two sides thereof, a stopping portion is formed on one end of a groove in the said base and said groove fits onto the tracks positioned at the two sides of said switch and positions on said stopping portion.

6. The structure of button for an electronic product according to claim 1, wherein said parallel bar set further comprises a spring at one end of said two sides of said two supporting racks to restore said upper lid back to the original position when said external force is removed.

7. The structure of button for an electronic product according to claim 1, wherein said switch of said chassis comprises a resilient element.

8. The structure of button for an electronic product according to claim 7, wherein said resilient element comprises silicon or rubber.

* * * * *